US011727747B2

(12) United States Patent
Stevens

(10) Patent No.: US 11,727,747 B2
(45) **Date of Patent: *Aug. 15, 2023**

(54) ELECTRONIC GAMING MACHINE

(71) Applicant: Racing Reels Limited, Makati (PH)

(72) Inventor: Wayne K. Stevens, Coorparoo (AU)

(73) Assignee: Racing Reels Ltd, Makati (PH)

( * ) Notice: Subject to any disclaimer, the term of this patent is extended or adjusted under 35 U.S.C. 154(b) by 0 days.

This patent is subject to a terminal disclaimer.

(21) Appl. No.: 17/563,571

(22) Filed: Dec. 28, 2021

(65) Prior Publication Data

US 2022/0122411 A1 Apr. 21, 2022

Related U.S. Application Data

(63) Continuation of application No. 16/391,489, filed on Apr. 23, 2019, now Pat. No. 11,244,534.

(60) Provisional application No. 62/802,442, filed on Feb. 7, 2019.

(51) Int. Cl.
*G07F 17/32* (2006.01)

(52) U.S. Cl.
CPC ..... *G07F 17/3225* (2013.01); *G07F 17/3209* (2013.01); *G07F 17/3211* (2013.01); *G07F 17/323* (2013.01); *G07F 17/3276* (2013.01); *G07F 17/3288* (2013.01)

(58) Field of Classification Search
CPC ..... G07F 17/3225; G07F 17/3209; G07F 17/3211; G07F 17/323; G07F 17/3276; G07F 17/3288
USPC ..... 463/46
See application file for complete search history.

(56) References Cited

U.S. PATENT DOCUMENTS 8,840,462 B2 * 9/2014 Patel ..... G07F 17/3276 463/16
2006/0246983 A1 * 11/2006 Huard ..... G07F 17/32 463/16
2008/0004117 A1 * 1/2008 Stamper ..... G07F 17/32 463/42
2011/0275425 A1 * 11/2011 Asher ..... G07F 17/3258 463/6

FOREIGN PATENT DOCUMENTS

CN 101901304 A * 12/2010

* cited by examiner

*Primary Examiner* — Allen Chan
(74) *Attorney, Agent, or Firm* — White and Williams LLP

(57) ABSTRACT

Certain embodiments of the disclosure can include methods and apparatus for electronic gaming. The methods and apparatus can include hosting and/or executing a computer game that can include one or more contestants. The methods and apparatus can include displaying the contest to contestants and noncontestants. And the methods and apparatus can include receiving a wager from a wagerer regarding an outcome of the contest.

16 Claims, 4 Drawing Sheets

ELECTRONIC GAMING MACHINE

CROSS REFERENCE TO RELATED APPLICATIONS

The present application is a continuation of pending U.S. patent application Ser. No. 16/391,489, filed Apr. 23, 2019, now U.S. Pat. No. 11,244,534, which claims the benefit of U.S. Provisional Patent Application No. 62/802,442, filed Feb. 7, 2019, the disclosures of which are hereby incorporated by reference in their entirety.

FIELD OF INVENTION

The present disclosure relates to electronic games, including casino slot gaming machines, electronic racing games and reel-based games.

BACKGROUND

Presently, casino and online slot machines do not allow for multiple players to participate in a single game. And a second player cannot wager on the outcome of the spins being played by a first player of a slot machine. Typically, in casino or online slot games, there are many different games from which a player can choose. However, the choice of which game to play is limited by the number of other players already playing those slot machines. A prospective player's choices are limited to only the vacant slot machines. Currently, there is no option to wager on a machine that is already occupied. There are many variations of the slot game but none offer multiplayer participation.

SUMMARY OF INVENTION

Some or all of the above needs and/or problems may be addressed by certain embodiments of the disclosure. Certain embodiments can include apparatus and methods for electronic gaming. According to one embodiment of the disclosure, there is disclosed an apparatus. The apparatus can include computer memory and a microprocessor for executing and managing an electronic gaming machine. The gaming machine can include a contest with two or more contestants. The machine can display the contest and can receive and process wagers placed by wagerers regarding the outcome of the contest.

According to another embodiment of the disclosure, there is disclosed a method. The method can include configuring a computing device to execute and manage an electronic contest. The method can include displaying the contest to one or more screens. The method can also include receiving and processing wagers on the outcomes of contests, the wagers made by wagerers.

Other embodiments, apparatus, methods, aspects, and features of the disclosure will become apparent to those skilled in the art from the following detailed description.

BRIEF DESCRIPTION OF DRAWINGS

The detailed description is set forth with reference to the accompanying drawings, which are not necessarily drawn to scale. The use of same reference numbers in different figures indicate similar or identical terms.

DETAILED DESCRIPTION OF THE PREFERRED EMBODIMENTS

In order that the present invention may be fully understood and readily put into practical effect, there shall now be described by way of non-limitative examples only preferred embodiments of the present invention, the description being with reference to the accompanying illustrative figures.

Figure 1:
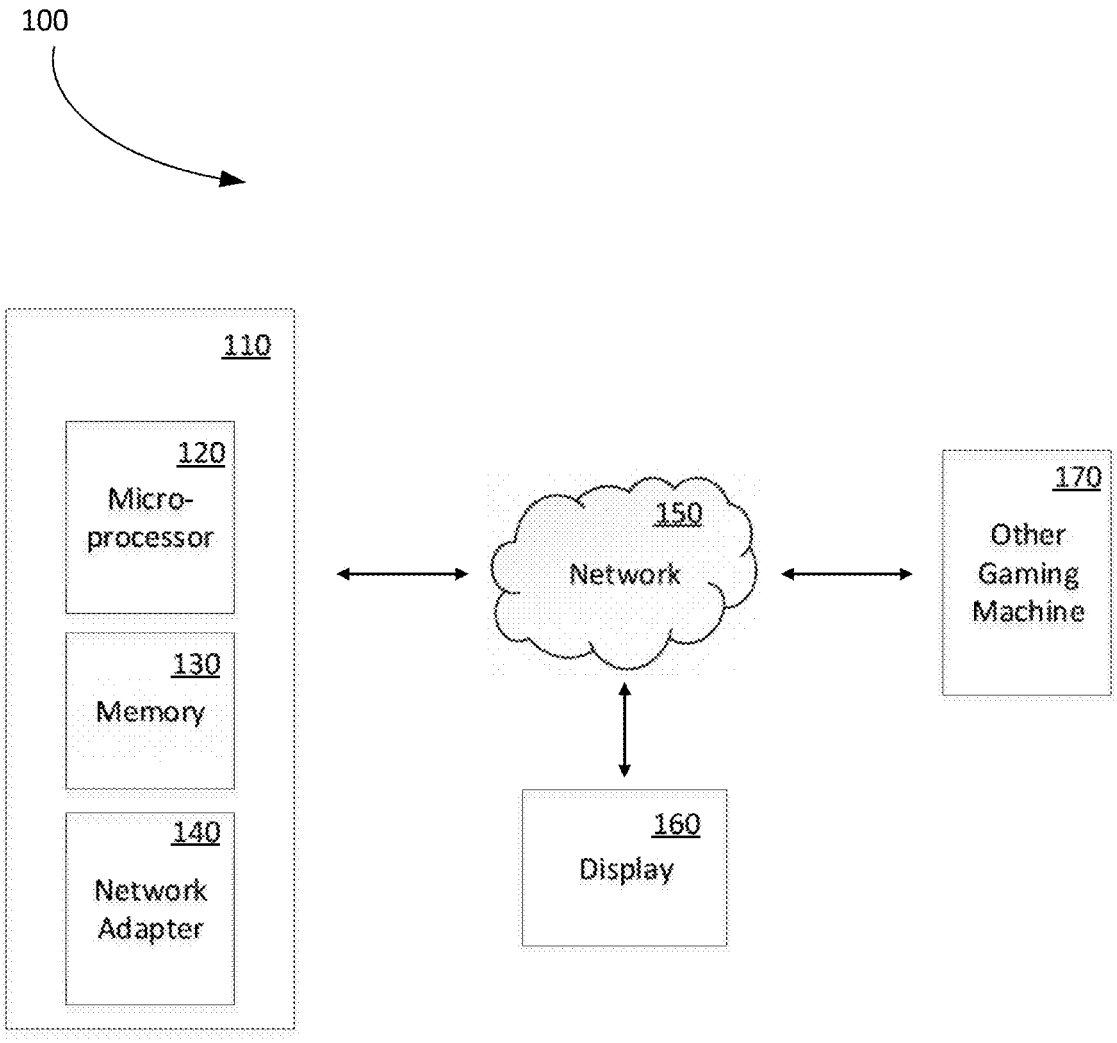
FIG. 1 is illustrates an example functional block diagram of an example electronic gaming machine, according to an embodiment of the disclosure.

Certain embodiments herein relate to electronic gaming management and wagering on electronic games. Accordingly, an apparatus can be provided to manage electronic games, such as games that include wagering. For example, FIG. 1 depicts an example block diagram. Gaming machine 110 can include one or more microprocessors 120. The microprocessors can be of any suitable type and ability for executing the algorithms and processes of the electronic game and management thereof. Gaming machine 110 can also include at least one memory 130 accessible by microprocessor 120. Memory 130 can include flash memory, RAM, ROM, removable storage, optical and magnetic storage, and any other suitable means for storing programs and/or information. In some embodiments, gaming machine 110 can include a network adapter 140 for communication with outside resources and/or other electronic gaming machines 170. Network adapter 140 can include more than one physical adapter in order to communicate with multiple types of networks, for example, Wi-Fi, LAN, modem, and Bluetooth. Apparatus can communicate outside gaming machine 110 through network 150. As mentioned above, network 150 can include any means of communicating between computing devices including, but not limited to, Wi-Fi, LAN, WAN (such as the Internet), Bluetooth, and telephony.

Apparatus 100 also includes at least one display 160. In some embodiments, display 160 can be the screen of the computing device utilized by gaming machine 110. In other embodiments, the processes and algorithms of apparatus 100 can be executed and stored on one computing device while display of the contest can occur on a physically disjoint display 160. In some embodiments, a single contest executing on machine 110 can be transmitted to multiple displays 160, and can be viewed on the multiple displays 160 either simultaneously or at different times. In some embodiments, apparatus 100 can be in communication with gaming machine 110 and at least one other gaming machine 170 via network 150. Apparatus 100 can monitor and manage multiple contests on multiple machines with many contestants simultaneously. Apparatus 100 can also monitor and manage a single contest spread across multiple machines and with many contestants.

Figure 2A:
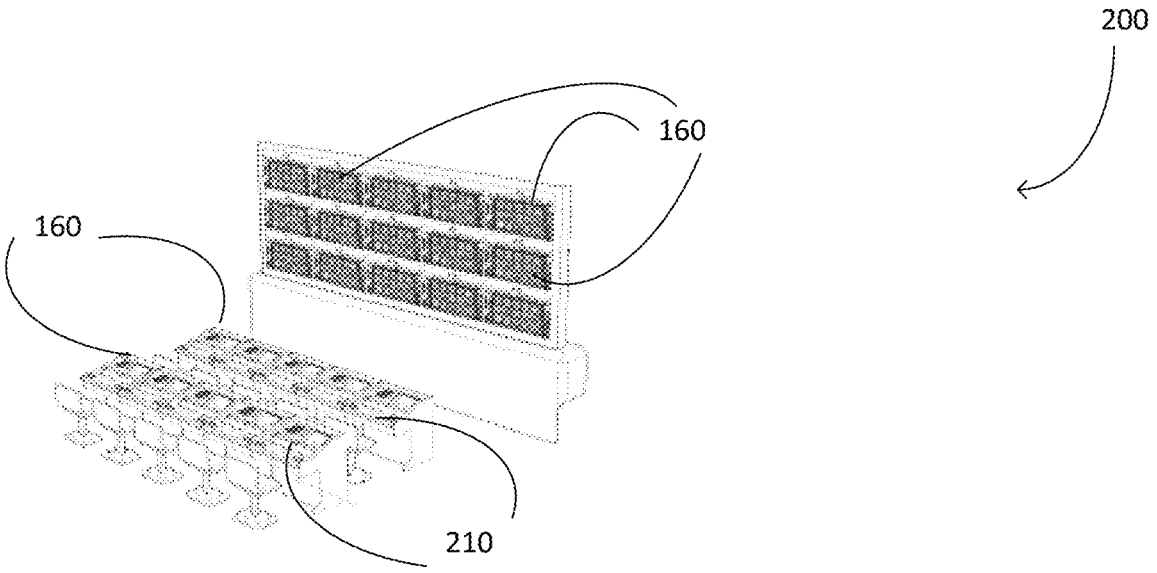
FIG. 2A illustrates an example multi-terminal gaming machine, according to an embodiment of the disclosure.
Figure 2B:
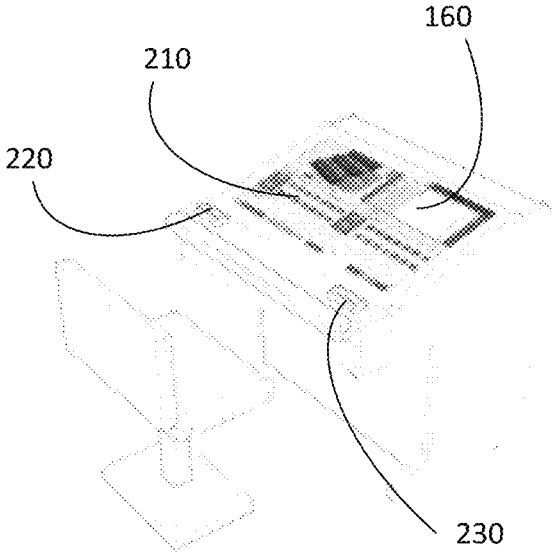
FIG. 2B illustrates an example wagering terminal, according to an embodiment of the disclosure.

With reference now to FIGS. 2A and 2B, depicted are example apparatus 200. In some embodiments, apparatus 200 can include many display screens 160 to show many contests or many contestants or both. In some embodiments, display 160 can include different images on different screens, even when both (or all) screens are connected to a single contest. For example, different wagerers sitting at different terminals can wager on a single contest, but their respective screens 160 can depict images different from the images displayed on the front screen 160. While a single contest can be coordinated among all those screens 160, the immediate display of a particular user's screen 160 can be customizable depending, for example, on a user's input. In some embodiments, a user can input display preferences via a keyboard or touch screen 210. Display preferences can include, but is not limited to, different races/games, history of those races/games, information about contestants competing in those races, current account information for the wagerer, and many other race-, game-, dealer-, and contestant-related information. Information can include statistics data such as the resultant position of each gaming machine 110 for the previous ten (or more) races; the number of races since the last time a particular machine 110 finished in first, second, or third position; and charts showing the end race balance of each machine for the previous ten (or more) races. In some embodiments, apparatus 200 can include a means for accepting cash value into a wagerer's account. For example, acceptor 220 can be configured to accept currency, value tickets, and credit cards in order to augment the account balance of a wagerer. In some embodiments, apparatus 200 can include a dispenser 230. Dispenser 230 can be configured to provide to the wagerer all or a portion of the wagerer's account balance, for example, in currency or in value ticket form. In some embodiments, the value ticket can be a casino "Cash Out" receipt that can be accepted in other casino machines.

Figure 3:
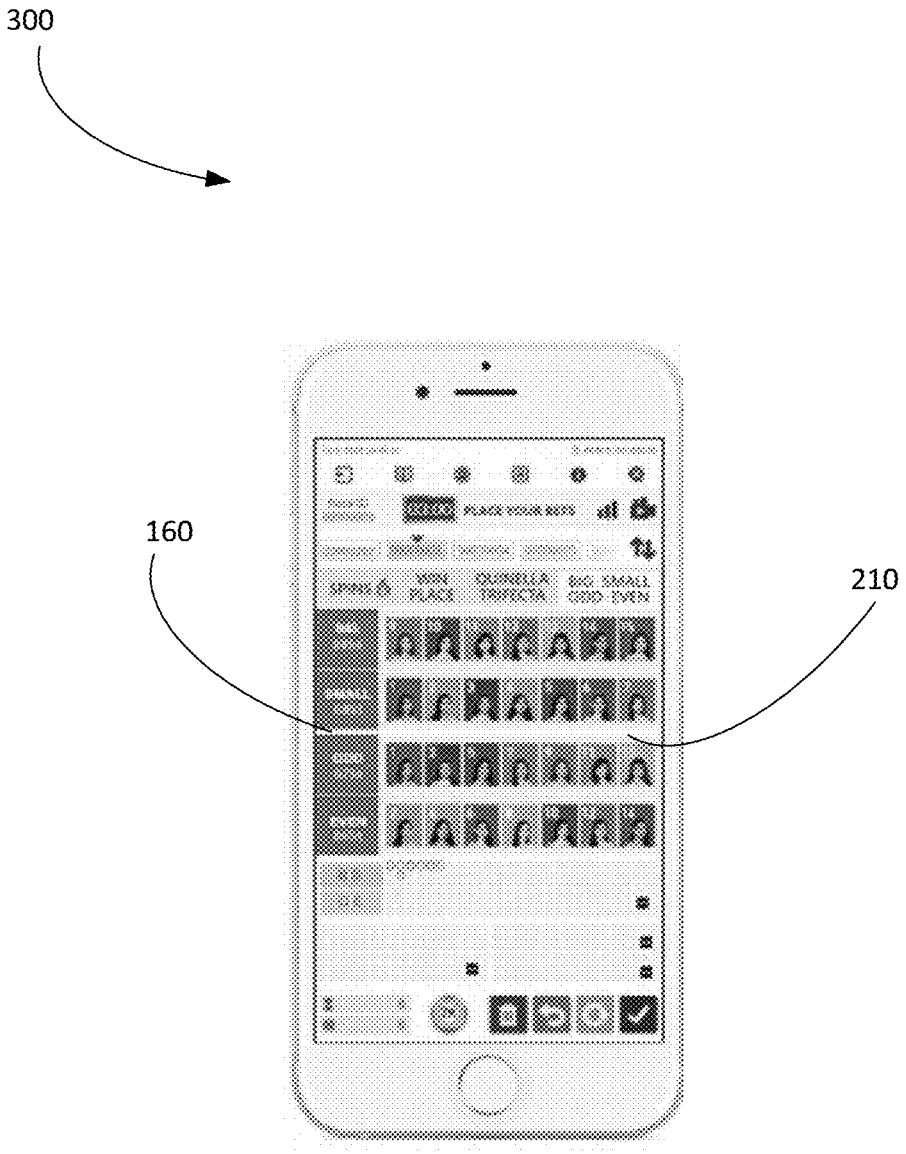
FIG. 3 illustrates an example mobile device software application, according to an embodiment of the disclosure.

With reference now to FIG. 3, depicted is an example illustration of an app designed for a personal computing device 300, such as a personal computer, smartphone, or tablet computer. The app can execute the functionality of apparatus 100, 200 and utilize the hardware of device 300 in conjunction with, or in lieu of, other hardware components of apparatus 100, 200. In some embodiments, display 160 and touch screen 210 can be satisfied by a single combined feature. Use of a personal computing device 300 can allow a wagerer to bet on contests taking place in a far-off casino (or elsewhere) from the comfort of the wagerer's home. Computing device 300 can connect via the Internet 150 to apparatus 100, 200 which can coordinate wagers and displays according to current or future contests. Whether using a personal computing device 300 or a casino terminal, apparatus 100, 200 can include a social network platform for integrated access to a contest via, for example, the Internet.

Figure 4:
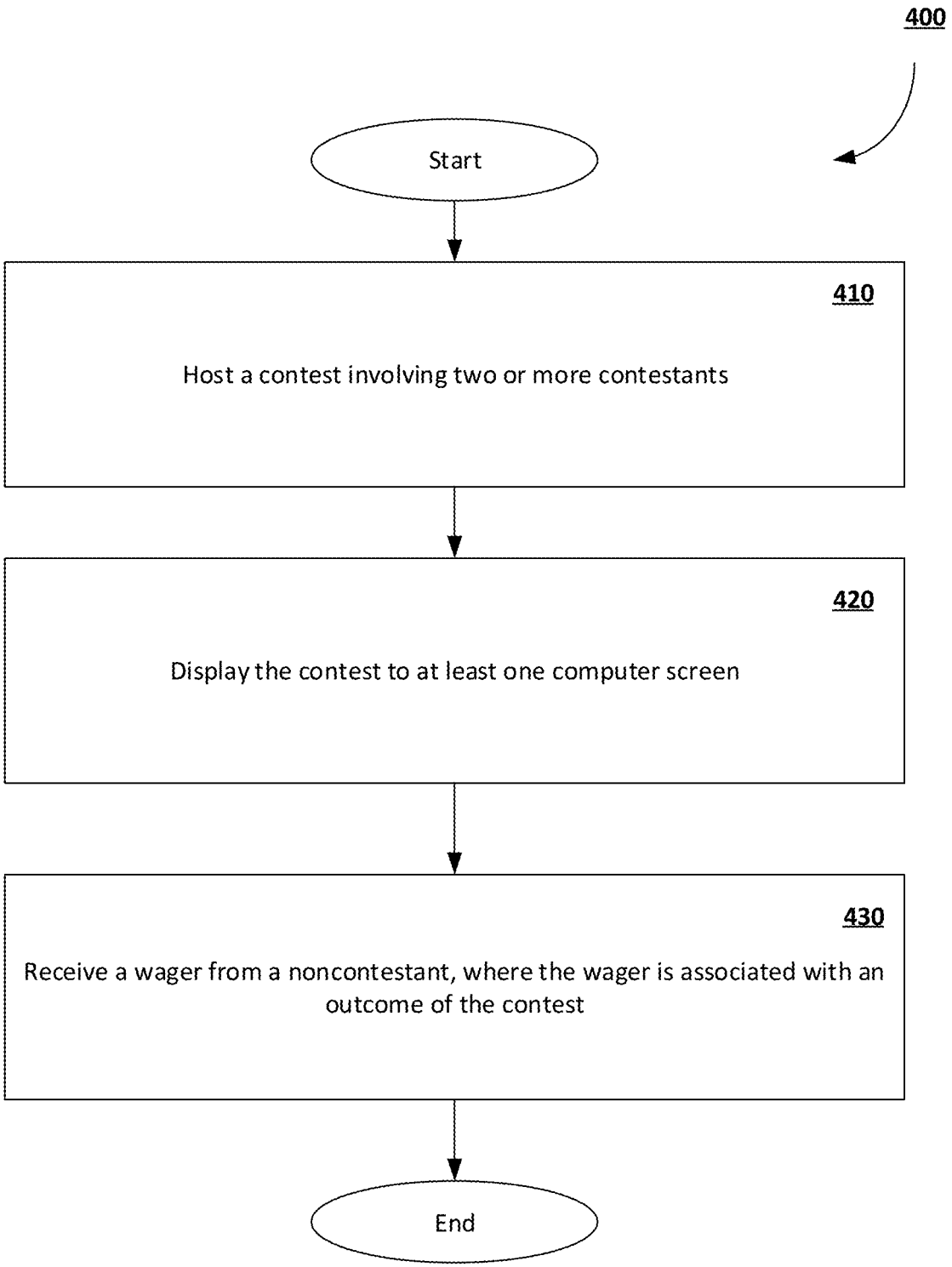
FIG. 4 is a flow diagram of an example method of managing an electronic gaming machine, according to an embodiment of the disclosure.

FIG. 4 is a flowchart illustrating a process for executing and managing an electronic game, according to various aspects of the present disclosure. The process 400 may begin at block 410. Starting with block 410, process 400 can execute and host an electronic contest, or game, that involves two or more contestants. In some aspects, the contest can be a race, such as a horse race or auto race. In other aspects, contents may be won by the contestant who completes a set number of spins to complete the race or alternatively a series of spins for a predetermined amount of time to complete the race. The race time may be a predetermined amount of time to complete one race. The race spins may be a predetermined number of spins to complete one race, and the wagering time may be time between races where players can place wagers on the upcoming race. In other aspects, the contest may be any competition where contestants can compete to win or to finish better than other contestants. The contestants can be persons playing the game from adjacent computer screens, for example in a casino, or the persons can be on opposite sides of the globe competing through a synchronized casino version of the game. The persons can also be playing via a mobile device, for example their personal mobile devices, and the contest can be synchronized through their respective apps, the software applications running on their mobile devices.

Some or all of the contestants can be computer-based; that is, process 400 can also include an algorithm that is capable of playing the game provided by process 400.

At block 420, process 400 can display the contest as well as information about the contest. Process 400 can display information about past contests. In some aspects, process 400 may display statistics about the winners of recent contests; the resultant position of each machine for the last predetermined number of races (e.g., 10 races); the number of races since the last time each respective machine got 1st/2nd/3rd position; the end race balance of each machine for the last predetermined number of races, where a first color indicates end race balance more than start balance and another color indicates end race balance less than end balance; and the machines that came in respective position/placing for the last predetermined number of races.

Process 400 can display the wagering history of past contests, including types of wagers made (e.g. Win, Place, Quinella, Trifecta, Quadrella, etc.), as well as the odds given for each wager, and the total amounts and winners of the wagers. Process 400 can also display information about future contests including, for example, information about wagers on the future contests that have already been placed. Process 400 can display the contest, before, during, after the competition. The display can be via a computer screen physically attached to the microprocessor and memory that is executing the contest program. Process 400 can also display the contest by transmitting display information to other devices that are communicably attached to the microprocessor and/or memory. In some embodiments, the contest can be running in one location (e.g. on a casino computer) and the contest can be displaying on a user's device halfway around the world. In some aspects, the user may be a contestant in the contest and may also be a wagerer, the user may be a noncontestant wagerer, and/or the user may be an audience member. Any game that is currently being contested can be displayed substantially synchronously on each device or screen for which there is a user who wishes to participate in the contest, in one way or another. For games that involve a dealer, the dealer can be either a person or a machine or an algorithm. In some embodiments, the dealer algorithm can also be a component of process 400. For contests that require a particular input in order to commence, a dealer action can be included in process 400. The dealer may be a person, algorithm, or mechanical device that triggers the commencement of the race or contest.

In some embodiments, display of the contest and of contest information can be via a computer touch screen. In these embodiments, a user can interact with the images on the screen in order to participate by, for example, competing in the contest, observing the contest, or wagering on the contest. In embodiments that include remotely located users or remotely located processors and/or hardware, process 400 can include connecting the necessary components via a computer network such as the internet. In this way, process 400 can connect to one or more other games of a similar type, for example, for including more contestants in a single game. By including more contestants, more outcomes become possible in a given contest, for example, the finishing order of the top ten (10) contestants may be wagered on only if there are two or more contestants. Process 400 can commence and manage many disparate gaming programs by, for example, centrally processing the game times, characteristics, and protocols, and transmitting sequences necessary to maintain substantial synchronization among the potentially widely spread contestants.

In some embodiments, the contest can require an administrator, such as a dealer in the form of a human or a robot. Depending on the particular contest, the dealer can be involved in the contest to varying degrees. Process 400 can receive input from the dealer(s) in order to effectively and synchronously manage the overall contest. In some embodiments, one or more of the dealer(s) can be algorithmic, including as a subprocess of process 400. When connecting multiple machines or instances of a contest among contestants, process 400 can evaluate and manage the different versions of the contest based on, for example, the age of the hardware or software running on those separate machines. Process 400 can then evaluate the different versions, if any, to determine whether or not each contestant is eligible to compete in the upcoming contest. If a version of the software or hardware is determined by process 400 to be too out of synch with the rest of the participants' versions, then process 400 can choose to prevent the offending machine(s) from participating in the contest because of unfairness that could arise as a result of the different hardware/software versions.

At block 430, process 400 can receive a wager regarding a current or future contest. The wager can be based on an outcome of the contest. A non-exhaustive and non-limiting list of betting options by process 400 include the following:

- Wagering on individual multiple spins
- WIN; PLACE; SHOW; QUINELLA; TRIFECTA; QUADRELLA;
- Whether the first place finisher has a contestant number that is ODD;
- Whether the first place finisher has a contestant number that is EVEN;
- Whether the first place finisher has a contestant number that is LOW, relative to the other contestant numbers; and
- Whether the first place finisher has a contestant number that is HIGH, relative to the other contestant numbers.

These and other outcomes will be determined by process 400 upon completion of a contest, and wagers based on these possible outcomes can be accepted prior to commencement of a contest and can also be accepted after a contest has started, based on certain criteria of that particular contest. A wager can be placed based on the number of credits recognized by process 400 associated with the wagerer. The number of credits available to a wagerer can be based on a credit limit of the wagerer, an amount of currency paid to the machine from the wagerer, and the amount of winnings the wagerer has earned in previous online gaming. The wager can also be placed based on an amount of currency placed into the machine by the wagerer, immediately prior to placing the wager.

The features of the present embodiments described herein may be implemented in digital electronic circuitry, and/or in computer hardware, firmware, software, and/or in combinations thereof. Features of the present embodiments may be implemented in a computer program product tangibly embodied in an information carrier, such as a machine-readable storage device, and/or in a propagated signal, for execution by a programmable processor. Embodiments of the present method steps may be performed by a programmable processor executing a program of instructions to perform functions of the described implementations by operating on input data and generating output.

The features of the present embodiments described herein may be implemented in one or more computer programs that are executable on a programmable system including at least one programmable processor coupled to receive data and/or instructions from, and to transmit data and/or instructions to, a data storage system, at least one input device, and at least one output device. A computer program may include a set of instructions that may be used, directly or indirectly, in a computer to perform a certain activity or bring about a certain result. A computer program may be written in any form of programming language, including compiled or interpreted languages, and it may be deployed in any form, including as a stand-alone program or as a module, component, subroutine, or other unit suitable for use in a computing environment.

Suitable processors for the execution of a program of instructions may include, for example, both general and special purpose processors, and/or the sole processor or one of multiple processors of any kind of computer. Generally, a processor may receive instructions and/or data from a read only memory (ROM), or a random access memory (RAM), or both. Such a computer may include a processor for executing instructions and one or more memories for storing instructions and/or data.

Generally, a computer may also include, or be operatively coupled to communicate with, one or more mass storage devices for storing data files. Such devices include magnetic disks, such as internal hard disks and/or removable disks, magneto-optical disks, and/or optical disks. Storage devices suitable for tangibly embodying computer program instructions and/or data may include all forms of non-volatile memory, including for example semiconductor memory devices, such as EPROM, EEPROM, and flash memory devices, magnetic disks such as internal hard disks and removable disks, magneto-optical disks, and CD-ROM and DVD-ROM disks. The processor and the memory may be supplemented by, or incorporated in, one or more ASICs (application-specific integrated circuits).

To provide for interaction with a user, the features of the present embodiments may be implemented on a computer having a display device, such as an LCD (liquid crystal display) monitor, for displaying information to the user. The computer may further include a keyboard, a pointing device, such as a mouse or a trackball, and/or a touchscreen by which the user may provide input to the computer.

The features of the present embodiments may be implemented in a computer system that includes a back-end component, such as a data server, and/or that includes a middleware component, such as an application server or an Internet server, and/or that includes a front-end component, such as a client computer having a graphical user interface (GUI) and/or an Internet browser, or any combination of these. The components of the system may be connected by any form or medium of digital data communication, such as a communication network. Examples of communication networks may include, for example, a LAN (local area network), a WAN (wide area network), and/or the computers and networks forming the Internet.

The computer system may include clients and servers. A client and server may be remote from each other and interact through a network, such as those described herein. The relationship of client and server may arise by virtue of computer programs running on the respective computers and having a client-server relationship to each other.

As desired, embodiments of the disclosure may include a device with more or fewer components than are illustrated in the drawings. Additionally, certain components of the device may be combined in various embodiments of the disclosure. The devices described above are provided by way of example only.

The above description presents the best mode contemplated for carrying out the present embodiments, and of the manner and process of practicing them, in such full, clear, concise, and exact terms as to enable any person skilled in the art to which they pertain to practice these embodiments. The present embodiments are, however, susceptible to modifications and alternate constructions from those discussed above that are fully equivalent. Consequently, the present invention is not limited to the particular embodiments disclosed. On the contrary, the present invention covers all modifications and alternate constructions coming within the spirit and scope of the present disclosure. For example, the steps in the processes described herein need not be performed in the same order as they have been presented, and may be performed in any order(s). Further, steps that have been presented as being performed separately may in alternative embodiments be performed concurrently. Likewise, steps that have been presented as being performed concurrently may in alternative embodiments be performed separately.

The operations described and shown in method 400 of FIG. 4 may be carried out or performed in any suitable order as desired in various embodiments of the disclosure, and process 400 may repeat any number of times. Additionally, in certain embodiments, at least a portion of the operations may be carried out in parallel. For example, block 420 and block 430 may take place at a single time, according to some embodiments of the disclosure. Furthermore, in certain embodiments, fewer or more operations than described in FIG. 4 may be performed.

What is claimed is:

1. An electronic gaming apparatus comprising:

at least one microprocessor or multi-microprocessor; and at least one memory storing computer-executable instructions wherein the at least one microprocessor or multi-microprocessor is operable to access the at least one memory and execute the computer-executable instructions to:

host a first contest involving two or more machines, where an outcome of the first contest results in one or more machines receiving a ranked position based on the performance of the two or more machines;

display the first contest;

receive a wager on the first contest from a wagerer prior to a start of the first contest or after the start of the first contest based on criteria of the first contest, the wager identifying the ranked position of one or more machines upon completion of the first contest, wherein the machines are algorithmic contestants, wherein the wager includes the ranked position of one of the one or more algorithmic contestants, wherein the first contest is a race in series of one or more races, and the outcome of the race is based on a score achieved from one of a predetermined number of spins of a slot-machine game and a number of spins of the slot-machine game completed in a predetermined time;

receive a first electronic device information transmission from a first electronic device associated with a first machine, the transmission comprising information regarding one of hardware and software associated with the first electronic device;

receive a second electronic device information transmission from a second electronic device associated with a second machine, the transmission comprising information regarding one of hardware and software associated with the second electronic device;

determine the first electronic device associated with the first machine has one of hardware and software deemed ineligible based on a comparison with the second electronic device associated with the second machine, wherein one of hardware and software are deemed ineligible based on one or more of versions or age of the hardware or software; and upon determining the first electronic device ineligible, prevent the first machine from participating in the first contest or configure the first electronic device to update one of the hardware or software.

2. The apparatus according to claim 1, further comprising a touch screen to receive the wager and to display the first contest.

3. The apparatus according to claim 1, further comprising at least one network adapter.

4. The apparatus according to claim 3, wherein the computer-executable instructions are further operable to connect, via the at least one network adapter, to at least one other apparatus.

5. The apparatus according to claim 4, wherein the computer-executable instructions are further operable to associate a second contest with multiple apparatus, the second contest associated with a second outcome.

6. The apparatus according to claim 5, wherein the computer-executable instructions are further operable to commence and manage, substantially simultaneously, game play for a plurality of electronic gaming apparatus.

7. The apparatus according to claim 1, wherein the computer-executable instructions are further operable to receive input from a dealer.

8. The apparatus according to claim 7, wherein the dealer is electronic.

9. A method for managing an electronic game, the method comprising:

hosting, via at least one memory, a first contest involving two or more machines, where an outcome of the first contest results in one or more machines receiving a ranked position based on the performance of the two or more machines;

displaying, via at least one display adapter, the first contest to at least one electronic screen;

receiving a wager on the first contest from a wagerer prior to a start of the first contest or after the start of the first contest based on criteria of the first contest, the wager identifying the ranked position of one or more machines upon completion of the first contest, wherein the first contest is a race in series of one or more races wherein the machines are algorithmic contestants, wherein the wager includes the ranked position of one of the one or more algorithmic contestants, and the outcome of the race is based on a score achieved from one of a predetermined number of spins of a slot-machine game and a number of spins of the slot-machine game completed in a predetermined time; and receiving a first electronic device information transmission from a first electronic device associated with a first machine, the transmission comprising information regarding one of hardware and software associated with the first electronic device;

receiving a second electronic device information transmission from a second electronic device associated with a second machine, the transmission comprising information regarding one of hardware and software associated with the second electronic device;

determining the first electronic device associated with the first machine has one of hardware and software deemed ineligible based on a comparison with the second electronic device associated with the second machine, wherein one of hardware and software are deemed ineligible based on one or more of versions or age of the hardware or software; and upon determining the first electronic device ineligible, preventing the first machine from participating in the first contest or configuring the first electronic device to update one of the hardware or software.

10. The method according to claim 9, wherein receiving the wager comprises receiving input via at least one touch screen.

11. The method according to claim 9, wherein receiving the wager comprises receiving input via at least one network adapter.

12. The method according to claim 11, further comprising connecting to at least one other electronic game.

13. The method according to claim 12, further comprising associating a second contest with the at least one other electronic game, the second contest associated with a second outcome.

14. The method according to claim 13, further comprising managing, via at least one microprocessor, substantially simultaneous game play among the at least one other electronic game.

15. The method according to claim 9, further comprising receiving input from a dealer.

16. The method according to claim 15, wherein the dealer is electronic.

* * * * *